United States Patent [19]

Balk

[11] Patent Number: 4,812,112

[45] Date of Patent: Mar. 14, 1989

[54] APPARATUS FOR MAKING A SPUN FLEECE FROM ENDLESS SYNTHETIC-RESIN FILAMENT

[75] Inventor: Hermann Balk, Troisdorf, Fed. Rep. of Germany

[73] Assignee: Reifenhauser GmbH & Co. Maschinenfabrik, Troisdorf, Fed. Rep. of Germany

[21] Appl. No.: 119,197

[22] Filed: Nov. 10, 1987

[30] Foreign Application Priority Data

Apr. 25, 1987 [DE] Fed. Rep. of Germany ..... 3713861

[51] Int. Cl.[4] ..... B29C 47/34

[52] U.S. Cl. ..... 425/66; 264/211.14; 264/237; 425/72.2

[58] Field of Search ..... 19/299, 300; 28/185, 28/240, 241, 273; 264/12, 103, 176.1, 177.17, 177.19, 210.8, 211.14, 211.17, 237, 290.5, 518, DIG. 73, DIG. 75; 425/66, 72.1, 72.2, 80.1, 81.1, 82.1, 83.1, 140, 141, 172, 462, 464

[56] References Cited

U.S. PATENT DOCUMENTS

| | | | |
|---|---|---|---|
| 3,787,195 | 1/1974 | Kirchheim | 425/81.1 |
| 3,812,553 | 5/1974 | Marshall et al. | 264/113 |
| 4,217,078 | 8/1980 | Buell | 425/81.1 |
| 4,340,563 | 7/1982 | Appel et al. | 425/72.2 |
| 4,388,056 | 6/1983 | Lee et al. | 425/83.1 |
| 4,442,062 | 4/1984 | Fujii et al. | 264/518 |
| 4,692,106 | 9/1987 | Grabowski et al. | 425/140 |

FOREIGN PATENT DOCUMENTS

| | | | |
|---|---|---|---|
| 2906618 | 8/1980 | Fed. Rep. of Germany | 264/237 |

*Primary Examiner*—Jay H. Woo
*Assistant Examiner*—C. Scott Bushey
*Attorney, Agent, or Firm*—Herbert Dubno

[57] ABSTRACT

A device for making a spun fleece has a spinning nozzle or spinneret system, a cooling shaft, a stretching gap, a diffuser shaft, a continuously moving fleece receiving conveyor and a device for feeding process air and for pulling or removing outflowing air through the fleece receiving conveyor. The cooling shaft has a shaft wall provided with a plurality of air orifices. Because of that process air required for the cooling is fed into the cooling shaft. The air flow at least partially is pulled through the fleece receiving conveyor and the spun fleece formed by the deposited endless filament loops. The deposited length of the endless filament loops is measured over the spun fleece width in the finished fleece. The measured value is compared with a predetermined set value. On deviation of the measured value from the set value the setting angles of the air control flaps pivotable about a horizontal axis which are located at the entrance of the stretching gap are changed. On a positive deviation of the measured value of the thickness from the set value the setting angles are decreased (deposited length larger than the set value).

4 Claims, 2 Drawing Sheets

APPARATUS FOR MAKING A SPUN FLEECE FROM ENDLESS SYNTHETIC-RESIN FILAMENT

FIELD OF THE INVENTION

My present invention relates to a device for making a spun fleece for making a spun fleece from a synthetic-resin filament.

BACKGROUND OF THE INVENTION

A device for making a spun fleece for making nonwoven mats is known comprising a spinning nozzle or spinneret system, a cooling shaft, a stretching gap, a diffuser shaft, a continuously moving fleece receiving conveyor and a device for feeding process air and for pulling outflowing air through the fleece delivery conveyor. The cooling shaft having a shaft wall is provided with a plurality of air orifices and process air required for cooling is introducible through the air orifices to provide an air flow. The air flow is at least partially drawn through the fleece receiving conveyor.

With the known device for making a spun fleece the deposited lengths of endless filament loops which substantially determine the quality of the manufactured spun fleece depend upon the flow rate of thermoplastic material which forms the endless filaments, according to the flow rate of the process air and according to the flow rate of outflowing air, the geometry of the device for making a spun fleece and other parameters. If one keeps the described parameters constant, the deposited lengths of the endless filament loops cannot be changed with ease. Particularly the loop lengths cannot be altered because of changes in the spun fleece width. If one changes the given parameters to adjust the deposited lengths, complex not easily reproducible structures result.

OBJECTS OF THE INVENTION

It is an object of my invention to provide an improved device for making a spun fleece for making a nonwoven mat from endless synthetic-resin filament whereby this drawback can be avoided.

It is also an object of my invention to provide an improved device for making a nonwoven mat of endless synthetic-resin filament in which the deposited lengths of the endless filament loops can change in the device for making spun fleece reproducibly in an easy way.

SUMMARY OF THE INVENTION

These objects and others which will become more readily apparent hereinafter are attained in accordance with my invention in a device for making a nonwoven mat comprising a spinning nozzle or spinneret system, a cooling shaft, a stretching gap, a diffuser shaft, a continuously moving fleece receiving conveyor and a device for feeding process air and for drawing outflowing air through the fleece receiving conveyor. The cooling shaft having a shaft wall is provided with a plurality of air orifices and process air required for cooling is introducible through the air orifices to provide an air flow. The air flow is at least partially passed through the fleece receiving conveyor.

According to my invention the diffuser shaft is provided with a plurality of pivoting flaps or flap defining a passage cross section and which are pivotally movable about a horizontal axis for adjustment of the deposited lengths of the endless filament loops. An adjustable damper above and/or below the fleece receiving conveyor can be combined with the device for drawing in outflowing air with which the width of the air, flow measured in the transport direction of the fleece receiving conveyor is adjustable.

The pivoting flaps can be adjusted to different setting angles over their entire length and may be elastically deformable over their entire length for this purpose.

It is understood that adjustment of the position of the pivoting flaps and the adjustable damper can be performed with the customary positioning drives which can be of a mechanical, pneumatic or hydraulic nature.

In the apparatus according to my invention the deposited length of the endless filament loops in the finished spun fleece is measured over the spun fleece width and the measured value is compared with a predetermined set value.

On deviation of the measured value from the set value the setting angles of the pivoting flaps pivotable about a horizontal axis and located in the diffuser shaft outlet change and of course the setting angles are reduced on a positive variation of the measured value from the set value (deposited length greater than the set value).

The deposited length can be measured on the or in the unit or also at another position. The measurement is undertaken by an operator for example.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figures 1, 2:
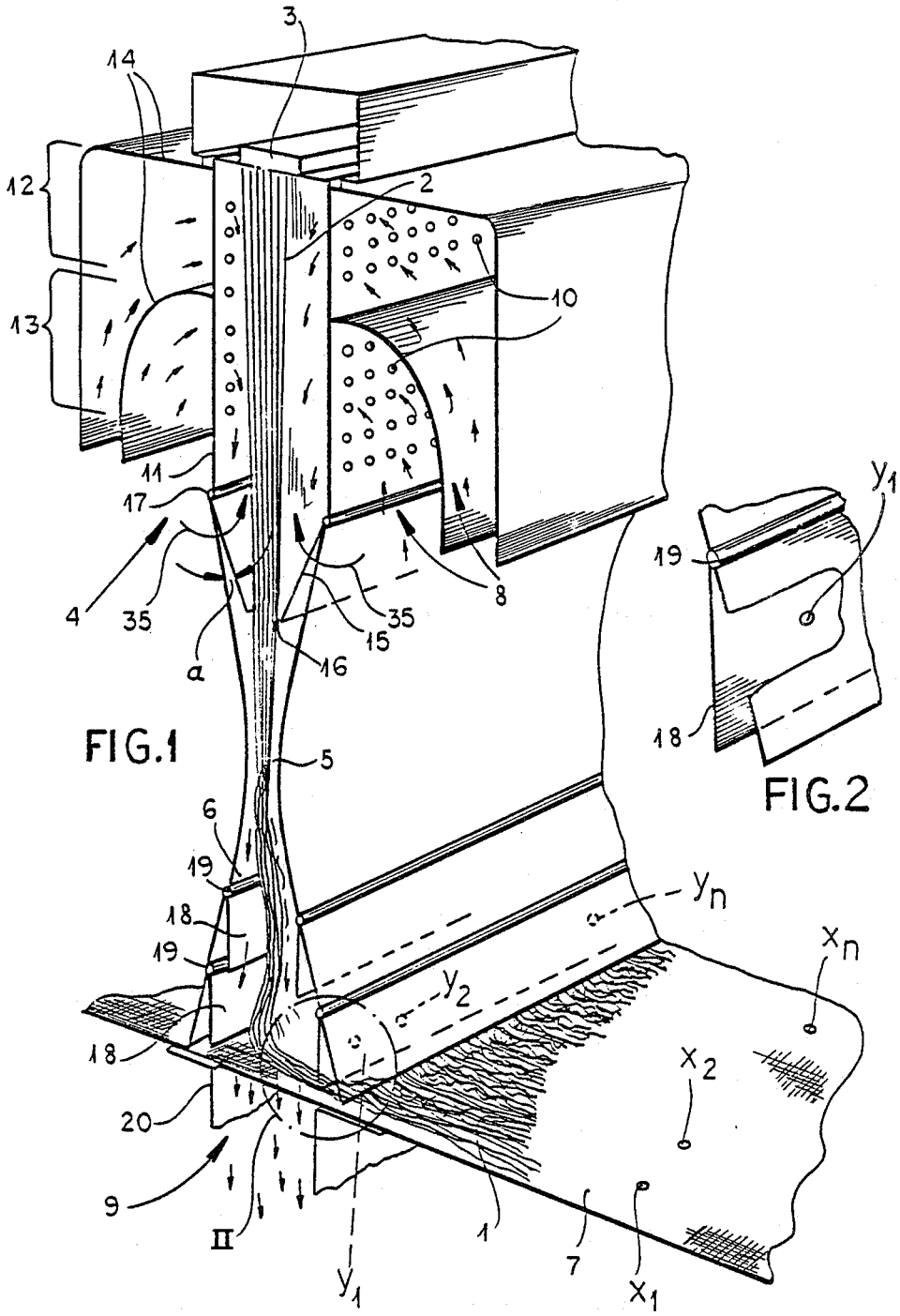
FIG. 1 is a perspective view of a vertically cutaway portion of device for making a spun fleece according to my invention.
FIG. 2 is a magnified vertical cross sectional view of the device for making a spun fleece of FIG. 1 corresponding to the portion A indicated by the dot-dashed line in FIG. 1.

The unit or apparatus shown in the drawing produces a spun fleece 1 made from endless synthetic-resin filaments 2.

This unit comprises a spinning nozzle or spinneret system 3, a cooling shaft 4, a stretching gap 5, a diffuser shaft 6 and a fleece receiving conveyor 7.

In addition devices 8, 9 for feeding process air and for drawing outgoing air through the fleece receiving conveyor 7 are provided.

The cooling shaft 4 has a shaft wall 11 provided with air orifices 10.

The shaft wall 11 however can also be formed as a flow directing device in the form of a screen or grid. In this manner process air required for cooling is introducible into the cooling shaft 4.

The cooling shaft 4 has an upper intensive cooling region 12 and a lower additional cooling region 13 as well as suitable air flow dividing guiding walls or a baffles 14 connected to the shaft wall 11. The air flow dividing guiding walls 14 are of adjustable height and the height of the intensive cooling region 12 is adjustable because of or by that height adjustability.

Air control flaps 15 converging like a wedge in the feed direction of the endless filaments 2 connected to the shaft wall 11 are connected in series with the stretching gap 5. These flaps 15 have an outlet gap 16 which opens to the stretching gap 5. These air control flaps 15 have an adjustable setting angle a and are movable about a horizontal axis 17 as is indicated in FIG. 1 by curved arrow 35. The structure is designed so that the setting angles a and thus the width of the outlet gap 16 is adjustable differently over the entire length of the air control flaps 15 (see FIG. 3). For that appropriate adjusting elements can be provided as described in connection with the latter FIG.

The diffuser shaft 6 is provided with pivotable flaps 18 defining the flow cross section and which are movable about a horizontal axis 19, e.g. defined by a piano hinge 27.

Opposing pairs are positioned above each other in this example in several steps and are adjustable independently of each other. Also they can be set at different setting angles with suitable adjusting elements.

The device 9 for drawing outflowing air has an adjustable damper 20 above and/or below the fleece receiving conveyor 7 with which the width of the outflowing air flow measured in the transport direction of the fleece receiving conveyor 7 is adjustable.

It can be operated with a closed or partially closed air flow for the process air and for the outflowing air. In any case the apparatus according to my invention does not operate with three separate air flows but with a single process air flow which, as described, is divided into a partial flow of air for the intensive cooling region 12 and a partial air flow for the additional cooling region 13.

In the described device for making a spun fleece the deposited length of the endless filament loops can be operationally adjusted. Furthermore the deposited length of the endless filament loops is measured in the spun fleece 1 over the spun fleece width and the measured value is compared with a predetermined set value. With the measurement a mean or average value is usually formed. Particularly the measurement of the deposited length can be performed at measuring points $x_1$, $x_2$, . . . , $x_n$ distributed over the entire width of the spun fleece. An average value can also be obtained. Correspondingly the setting angles of the pivoting flaps 18 can be adjusted at corresponding adjusting points $y_1$, $y_2$, . . . , $y_n$. These flaps can be deformable elastically.

By the device for feeding process air I mean the shaft wall 11 with the outlet orifices 10, the baffles 14 and other similar items as well as an air blower or pump (not shown).

Figure 3:
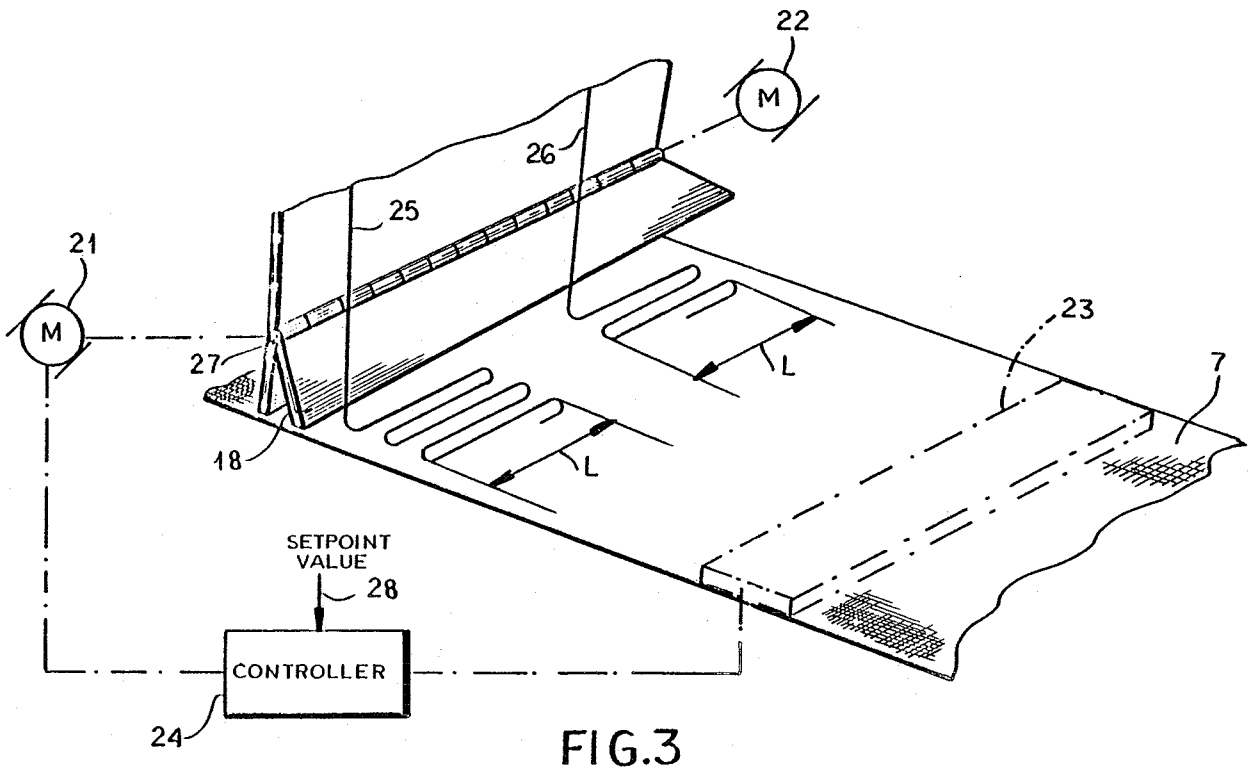
FIG. 3 is a diagram illustrating one mode of control which can be used in accordance with the invention.

As can be seen from FIG. 3, the sensing of the loop lengths L in the width direction, shown only for two monofilaments 25, 26 of the set produced by the spinneret (FIG. 1), can be effected by the sensing unit 23 which can detect the respective lengths at the different points across the width of the nonwoven fleece or mat as described. The unit 23 can represent an operator capable of distinguishing the loops and of inputting a control signal to the controller 24 or an automatic device responsive to the locations of bights of each loop and likewise inputting the control signal to the controller which can be a comparator comparing the length value to a setpoint value. The output of the controller 24 is applied to the servomotors 21 and 22 which are coupled to the opposite end of the flexible flap 18 and can rotate the latter about its axis 27 to the same degree or to different degrees (as shown) so as to regulate the loop length to restore the length, upon a deviation, to the setpoint value. Simply by varying the setpoint value 28, it is possible to control the loop lengths across the breadth of the nonwoven mat without varying any of the other operating parameters, such as the rate of flow of the synthetic resin from the spinneret, the airflow, etc.

I claim:

1. An apparatus for making a spun filament fleece comprising:

a spinneret;

a cooling shaft provided with a stretching gap, said cooling shaft having a shaft wall provided with a plurality of air orifices and process air required for cooling being introducible through said air orifices to provide an air flow;

a diffuser shaft;

a continuously moving fleece receiving conveyor;

as device for feeding process air and for drawing outflowing air through said fleece receiving conveyor, said air flow being at least partially passed through said fleece receiving conveyor;

at least two opposing elastically deformable pivoting flaps each having a horizontal pivot axis which are provided in said diffuser shaft below said wall and whose setting angles are synchronously adjustable against said air flow defined by the deviation of measured values of received lengths of a plurality of endless filament loops from set values; and an adjustable damper below said fleece delivery conveyor combined with said device for feeding said process air and for drawing said outflowing air with which the width of said air flow measured in the transport direction of said fleece receiving conveyor is adjustable, said flaps being adjustable to different setting angles over the entire length of each of said pivoting flaps.

2. In an apparatus for making a spun filament fleece comprising a spinneret, a cooling shaft extending downstream from said spinneret, a stretching gap immediately downstream of said cooling shaft, a diffuser shaft immediately downstream of said stretching gap, a continuously moving fleece receiving conveyor and a device for feeding process air and for drawing outflowing air through said fleece receiving conveyor, said cooling shaft having an upright shaft wall provided with a plurality of air orifices and process air required for cooling being introducible through said air orifices to provide an air flow and said air flow being at least partially passed through said fleece receiving conveyor, the improvement wherein said diffuser shaft is provided with a plurality of elastically deformable pivoting flaps below said wall and above said conveyor and defining a passage cross section traversed by a continuously moving fleece, and means for moving said flaps for adjustment of a deposited length of a plurality of endless filament loops of said spun fleece, said flaps being adjustable to different setting angles over the entire length of each of said pivoting flaps.

3. The improvement defined in claim 1 which further comprises an adjustable damper below said fleece receiving conveyor for feeding said process air and for drawing said outflowing air with which the width of said air flow measured in the transport direction of said fleece receiving conveyor is adjustable.

4. An apparatus for making a spun filament fleece comprising:

a diffuser shaft;

a continuously moving fleece receiving conveyor;

a device for feeding process air and for drawing outflowing air through said fleece receiving conveyor, said air flow being at least partially passed through said fleece receiving conveyor; and at least two opposing elastically deformable pivoting flaps below said device and above said conveyor, each of said flaps having a horizontal pivot axis which are provided in said diffuser shaft whose setting angles are synchronously adjustable against said air flow defined in the deviation of measured values of received lengths of a plurality of endless filament loops from set values, said flaps being adjustable to different setting angles over the entire length of each of said pivoting flaps.

* * * * *